US007175178B2

(12) United States Patent
El Kai

(10) Patent No.: US 7,175,178 B2
(45) Date of Patent: Feb. 13, 2007

(54) CASINO GAME

(76) Inventor: Bachir Georges El Kai, Sector 3, Street 46-50, Building 18, 6th Floor, Adonis, Zouk Mosbeh, Kesserwan (LB)

( * ) Notice: Subject to any disclaimer, the term of this patent is extended or adjusted under 35 U.S.C. 154(b) by 46 days.

(21) Appl. No.: 10/895,101

(22) Filed: Jul. 21, 2004

(65) Prior Publication Data

US 2005/0051966 A1 Mar. 10, 2005

(30) Foreign Application Priority Data

Jul. 25, 2003 (EP) ..... 03291840

(51) Int. Cl.
*A63F 1/00* (2006.01)

(52) U.S. Cl. ..... 273/274; 273/292; 273/309

(58) Field of Classification Search ..... 273/274, 273/309, 292, 148 R, 209; 463/12, 13, 16–19
See application file for complete search history.

(56) References Cited

U.S. PATENT DOCUMENTS 3,998,462 A * 12/1976 Goott ..... 273/274
4,149,728 A * 4/1979 Thompson ..... 273/274
4,441,714 A * 4/1984 Goott ..... 273/144 B
5,184,821 A * 2/1993 Korenek ..... 273/138.2
5,683,084 A * 11/1997 Dean et al. ..... 273/148 R
5,772,211 A * 6/1998 Nazaryan et al. ..... 273/292
5,918,884 A * 7/1999 DiMuro ..... 273/292
6,065,752 A * 5/2000 Beltran ..... 273/274
6,264,200 B1 * 7/2001 Smith ..... 273/274

FOREIGN PATENT DOCUMENTS

FR 526357 * 10/1921 ..... 273/274

* cited by examiner

*Primary Examiner*—Benjamin Layno
(74) *Attorney, Agent, or Firm*—Breiner & Breiner, LLC

(57) ABSTRACT

A new casino game is disclosed. The casino game has a new layout, card draw, payouts, and dealing procedures. The casino game uses a standard deck of fifty-two cards. The layout of the casino game has a high return area, optional bets area, card value area, color chips area, cash chips area and card stand. The card value area has a card value box for each of the thirteen valued cards from the deck. Adjacent to each card value box is a suit box for each of the four suits. The optional bets area has a straight, flush, straight flush, royal flush, full house and four-of-a-kind box. The bets offered are even chances, high stakes chances and very high stakes chances. The players win if the cards drawn match the bets that they have placed on the layout. The casino game has various payouts for the possible winning cards/bets.

26 Claims, 4 Drawing Sheets

CASINO GAME

FIELD OF INVENTION

The present invention relates to a new casino game. Specifically, the casino game has a new and unique layout, a new card draw, new payouts, and new dealing procedures. The layout of the casino game of the present invention is preferably made so that players can place their bets easily and with no complications, no matter whether they are betting on one or a series of cards from among the fifty-two cards in a deck of cards. The casino game uses a standard deck of cards having thirteen valued cards in each of four suits, i.e., hearts, diamonds, spades and clubs. The layout of the casino game preferably has a high return area, an optional bets area, a card value area, a color chips area, a cash chips area and a card stand. The card value area preferably comprises thirteen card value boxes corresponding to the thirteen card values and four suit boxes with each card value box.

BACKGROUND OF THE INVENTION

Gambling and playing games is a traditional past time and source of enjoyment for many people. Traditional games in a casino include slot machines, card games, dice games and other games. However, many games in a casino can be difficult to play, require skill by the players and/or require advance knowledge of intricate playing rules of the game. As such, many gamblers, including novice gamblers or occasional gamblers, avoid playing many games in a casino or easily loose their money because they are unsure of how to properly play the games.

Accordingly, a need exists for a casino game which is simple and quick to understand for even novice and occasional gamblers, while providing fun and entertainment to all players. The present invention addresses this need and the problems of prior casino games.

OBJECTS AND SUMMARY OF THE INVENTION

The present invention relates to a new casino game created to entertain any of a casino's punters. The casino game has a new and unique layout, a new card draw, new payouts and new dealing procedures. While the casino game comprises a deck of cards having fifty-two cards, the method of playing the casino game, its layout, its payouts, its bets offered, its card draw and its gambling philosophy are new, unique and different. The casino game may be played by betting on either a value of a card, a value of a card and its suit, or a combination of cards. The card draw preferably comprises six cards being drawn from a deck of fifty-two cards. The possible combinations of the cards drawn are preferably based on a maximum of five cards from out of the six cards drawn.

The layout of the card values and their suits and betting areas is a new layout which allows the game to be easily understood by the players. The layout also provides an aesthetic appeal inside the casino because of its beauty and the well organized layout.

The casino game of the present invention may comprise a different card draw or may also be in the form of a slot machine set-up or a home-use embodiment, such as, but not limited to, being small enough so that it is easily portable.

A primary object of the present invention is to provide a casino game which has a new and unique layout, card draw, payouts and dealing procedures which are based upon using a standard deck of cards.

Another primary object of the present invention is to provide a casino game having a layout such that players can place their bets easily and with no complications, no matter whether they are betting one or a series of cards from among the fifty-two cards in a standard deck of cards.

Another primary object of the present invention is to provide a casino game which is simple and quick to understand for even novice and occasional gamblers, which provides fun and entertainment to all players.

BRIEF DESCRIPTION OF THE DRAWINGS

Referring to the drawings.

DETAILED DESCRIPTION OF THE PREFERRED EMBODIMENTS

Figure 1:
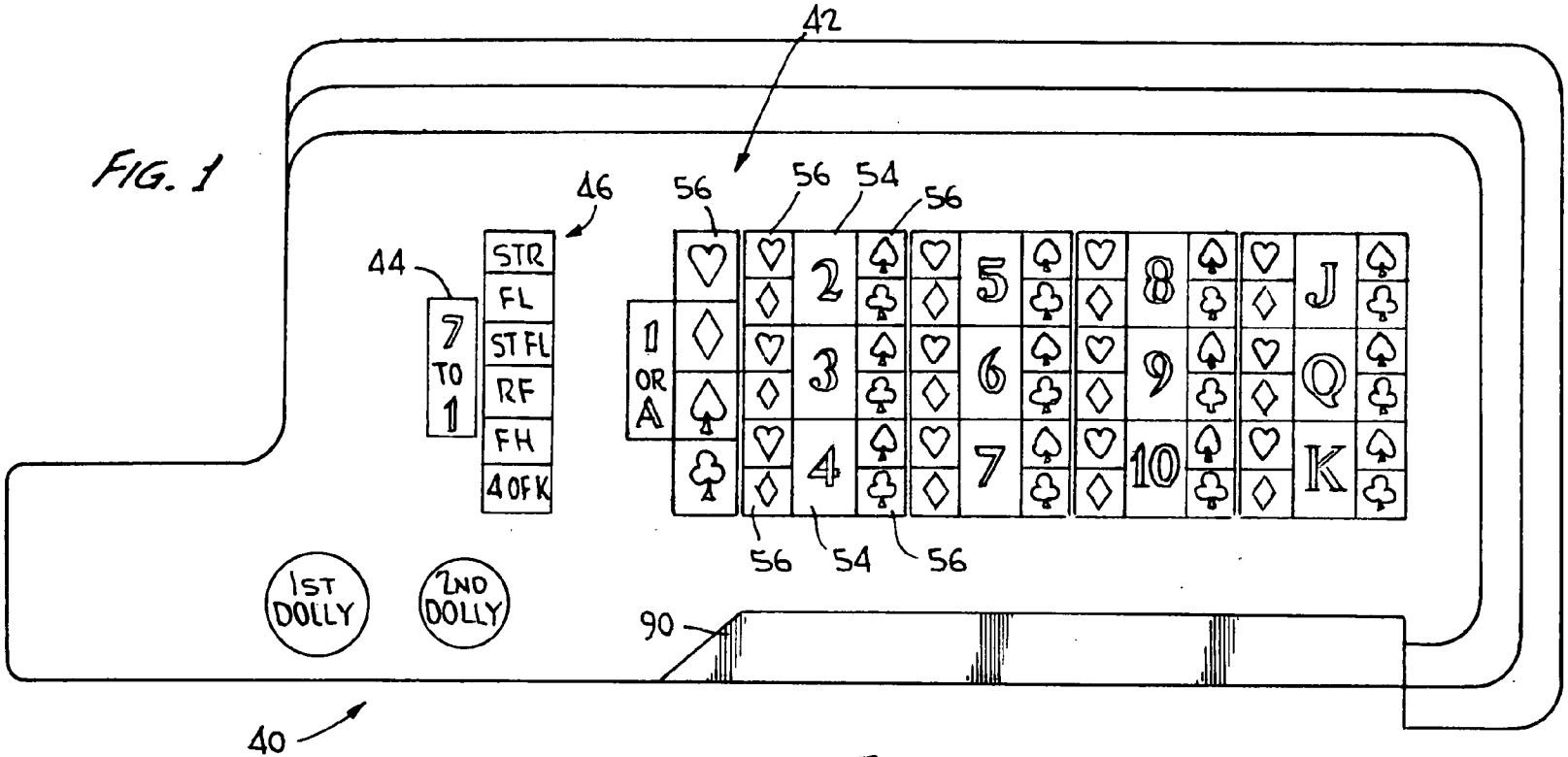
FIG. 1 is a top view of the casino game of the present invention.

The present invention relates to a new casino game. Specifically, the casino game 40 has a new and unique layout, a new card draw, new payouts, and new dealing procedures. The casino game 40 preferably uses a standard deck of cards having thirteen valued cards in each of four suits, i.e., hearts, diamonds, spades and clubs.

The layout 42 of the casino game 40 of the present invention is preferably designed so that the players can place their bets easily and with no complications, no matter whether they are betting one or a series of cards from among the fifty-two cards in a deck of cards. Referring to FIGS. 1–5, the layout 42 of the casino game 40 preferably has a card value area 48, a high return area 44, an optional bets area 46, a color chips area, a cash chips area and a card stand 90. The color chips area and cash chips area may be located in any suitable position on the casino game 40. The card value area 48 preferably comprises thirteen card value boxes corresponding to each of the thirteen card values in a deck of cards and four suit boxes with each card value box corresponding to each suit.

The card value area 48 preferably comprises a card value box 54 for each of the thirteen valued cards in the deck, i.e., 2–10, jack, queen, king and ace or one. Adjacent to each card value box 54 is a suit box 56 for each of the four card suits, i.e., a box for hearts, diamonds, spades and clubs. The optional bets area 46 preferably comprises an optional bets box for each of the following optional bets in a preferred arrangement of: straight 60, flush 62, straight flush 64, royal flush 66, full house 68 and four-of-a-kind 70.

The high return area 44 is an area reserved for dealer use only, and not for players. The high return area 44 is preferably used by the dealer in making payouts. For example, if a player won on more than one suited card, i.e., card value and its suit, in the same hand, i.e., from among the six cards drawn, the dealer would move those winning chips into the high return area 44 to make the payout. This saves time and makes payouts easier for the dealer. As such, the value assigned to the high return area 44 is preferably the same as the rate of return for the high stakes chances. In a preferred embodiment, the rate of return for the high stakes chances and as such, the value of the high return area 44 is 7-to-1. Use of the high return area 44, payouts and rates of return are described in greater detail hereafter.

In addition to the game layout 42, the casino game 40 also preferably comprises the following components: six big dollies, and one small dolly, i.e., markers, one standard deck of cards having fifty-two cards, a cards high stand, cash and color chips, a plunger for cash and cash box, and optionally a card shuffle machine. In playing the casino game 40 of the present invention, various bets may be made. In a preferred embodiment, three types of bets may preferably be made. The first bet type is even chances. This comprises playing/betting a single valued card without indicating its suit or color. The second bet type is high stakes chances. This preferably comprises playing/betting a single valued card and its suit. The third bet type is very high stakes chances. This preferably comprises playing/betting the optional bets which are based on a combination of five cards from among the six cards drawn. The optional bets preferably include, but are not limited to, straight, flush, straight flush, royal flush, full house and four-of-a-kind. As such, very high stakes chances require playing/betting on the outcome of multiple cards drawn, not just a single card.

Since a player has a variety of bet types, various rates of return may also be used if a player wins his bet. The following are preferred rates of return for the preferred bets in the casino game 40 of the present invention:

(1) even chances pays even money when a player hits, i.e., wins a bet, on one valued card; even chances pays 3-to-1 when a player's card is doubled among the six cards dealt, for example one pair; even chances pays 5-to-1 when a player's card is tripled among the six cards dealt, for example three of a kind; even chances pays 7-to-1 when a player's card comes out four times among the six cards dealt, for example four-of-a-kind.

(2) High stakes chances pays 7-to-1 when a winning card value with its suit is among the six card drawn, for example ace of hearts, eight of clubs, ten of spades, etc.

(3) Very high stakes or optional bets chances, which is based on a combination of five cards from the six cards drawn, pays when a player hits, i.e., wins a bet, as follows:

Straight: pays 5-to-1, for example five consecutive cards of any color or suit;

Flush: pays 10-to-1, for example five cards which are not consecutive but are from the same suit;

Straight Flush: pays 1000-to-1, for example five consecutive cards from the same suit;

Royal Flush: pays 2000-to-1, for example five consecutive cards from the same suit but which is ace high;

Full House: pays 20-to-1, for example any combination of three of the same valued cards plus a different two cards having the same value;

Four-of-a-Kind: pays 200-to-1, for example any four cards of the same value.

In another preferred embodiment, the very high stakes chances or optional bets chances may pay as follows: straight pays 25-to-1, flush pays 50-to-1, straight flush pays 1000-to-1, royal flush pays 2000-to-1, full house pays 100-to-1 and four-of-a-kind pays 500-to-1.

While the preferred payouts or rates of return on winning bets have been described above, any suitable rates of return may be used in accordance with the present invention and be in accordance with the scope of the invention.

The pushing and the stacking of the chips in the present invention strictly follows casino procedures. For example, all of the chips are preferably stacked in groups of twenties and as follows:

twenty chips plus up to ten extra chips on top from any denomination are still one stack; over thirty chips are in two stacks; over fifty-three chips are in three stacks; over seventy-three chips are in four stacks; over ninety-three chips are in five stacks; over one hundred-thirteen chips are in six stacks; over one hundred thirty-three chips are in seven stacks; over one hundred fifty-three chips are in eight stacks; etc.

The method of playing the casino game 40 of the present invention preferably commences by the players exchanging money for chips. However, the players may use money or chips to place their bets. The players then place their bets, i.e., money or chips, on a selected area of the casino game 40. This includes placing their chips on a card value box 54, a suits box 56 and/or in the optional bets area 46. The dealer then instructs all players to place their final bets. While this occurs, the dealer shuffles the cards, either manually or with a card shuffle machine depending on which embodiment is used. The dealer then announces "No more bets" indicating no change, addition or subtraction of bets may occur until the next round. In an embodiment having a card shuffle machine, the dealer pushes the stopping button to stop the card shuffle machine.

The dealer then preferably deals six cards, placing each one on the card stand 90. The dealer announces each card by its rank, i.e., number/value and suit of the card (for example: the first card is a king of spades, etc.). Any winning bets are then paid out accordingly, including, but not limited to, even chances, high stakes chances, and very high stakes chances or optional bets chances. The method of the present invention is described in greater detail hereafter.

More particularly, before dealing, the dealer straightens up the dollies and then announces "place your bets". While the players are placing their bets, the dealer shuffles the cards. This may be done manually or with a card shuffle machine. In an embodiment using manual shuffling, the dealer has to shuffle the cards in a very secure way, i.e., a silent shuffle and with no mushrooms, i.e., puffing up of the cards. The cards should then be placed in the shoe (card drawing box). In an embodiment using a card shuffle machine, the dealer has to place the cards in the shuffling machine, give the players some time to place their bets, announce "no more bets", and press the stopping button on the card shuffle machine.

After shuffling is complete, the dealer draws the six cards one at a time, placing face down on the high card stand 90, preferably announcing the position of each card drawn. For example, the dealer preferably announces first card out, second card out, . . . sixth card out. Then the opening, i.e., revealing, of the cards preferably starts from the right to the left.

When the dealer opens each card, the dealer preferably declares the card value and the suit of the card. The dealer then places one of the six big dollies on the card value box 54 of the casino game 40 which matches/corresponds to the value of the card revealed/drawn, preferably using his right hand. The dealer also places a small dolly on the suit box 56 corresponding to the card drawn. The dealer keeps the losing even money bets, dolly and chips and moves the winning color chips with the left hand from their boxes on the layout to the high return area on the left, lining them by color. After all six cards are drawn, there is a chance of having the same card value drawn X times, e.g., three kings or four queens, so that the dealer has to place X dollies inside of the same matching card value box on the layout 42. For example, if a card having a value of 10 is drawn three times, the dealer places three big dollies inside the "10" card value box. In the case of having the same color chips, i.e., the same player, winning on different card colors, i.e., multiple wins for the same color, the dealer preferably stacks them together in the high return area 44 so that the dealer can easily make the payouts on these winning bets.

More particularly, in the casino game 40 of the present invention, the dealer preferably manages the dollies as follows. When a red card is out, the dealer has to place the color dolly, i.e., small dolly, before the number dolly, i.e., big dolly, holding the small dolly preferably in the left hand and the big dolly in the right. Then, the dealer lifts the color dolly in the left hand and takes the winning chips out in the right hand to the high return area 44. When a black card is out, the big dolly should be placed first with the left hand and the small dolly second with the right hand. The dealer then lifts the small dolly with the right hand, and takes the winning color chips to the high return area 44 in the left hand. The ace card is an exception to the above description, wherein the card number dolly preferably is placed before the color dolly so that the big/number dolly is placed in the left hand and the small dolly in the right hand, thereby lifting the small dolly in the right hand and taking the winning color chips in the left hand to the high return area 44. The dealer can then easily make the winning payouts.

Thereafter, the cards should be lined up in an ascending manner so that if there was no winning optionals, the dealer declares "optionals down" (lose), placing the small dolly on the cards high stand 90, and then the clearing of the optional bets will take place with the whole clearing process. If there is any winning optional(s), the dealer may declare the winning optional(s) and may then place the small dolly in the winning optional(s) box or on the line between the two appropriate boxes.

The optional bet area 46 is preferably arranged so that if, for example, a royal flush comes out, the straight flush, the flush and the straight are also winners so that one dolly on the royal flush box 66 means that the upper three boxes are also winners. If a straight flush comes out, the flush and the straight are also winners, so one dolly on the straight flush box 64 means that the upper two boxes are also winners. If a straight and a flush come out, the dolly should be placed on the line between the two boxes. A straight and a flush could come out in the same deal since only five cards are preferably needed to form these hands and six cards are preferably dealt in the casino game of the present invention. If a full house and a four-of-a-kind come out, the dolly should be placed on the line between those two boxes. A full house and a four-of-a-kind could come out in the same deal since only five cards are needed for the full house, four cards are needed for the four-of-a-kind, six cards are preferably dealt and at least one card could be used in both hands. If only one of a straight, a flush, a full house, or a four-of-a-kind comes out, then the dolly is preferably placed inside that box in the optional bets area 46.

In clearing a layout in the casino game 40, it is important to remember that six big dollies are preferably on six winning numbered cards so the dealer should be aware not to cover by any chance any winning bets while clearing the layout. The clearing preferably starts from the bottom of the table towards the top and from up to down. The dealer preferably uses the left hand to brush the losing numbers/cards to the right direction leaving them in the color area (where the losing chips are also placed). The dealer then preferably brings down the losing chips using his right hand and with the same hand, scoops them to the left direction, thereby placing the losing chips under the next color column. The same clearing procedure is preferably done with the colors of each number box area until reaching the ace and all of the losing chips are placed under the optional bets area 46. If the ace is not a winner, this is preferably the only exception when the dealer brings down with the left hand and scoops all the losing chips to the chipping area.

If none of the optional bets is a winner, the dealer preferably brings down the losing chips with his left hand by scooping them down to the chipping area. If any of the optional bets is a winner, the dealer preferably picks up the losing chips with his left hand without covering the winning boxes, and places them with the other cleared chips in the chipping area.

Paying the winning numbers preferably occurs as described hereafter. While paying the even chances, the dealer may follow the sequence of paying from the bottom to top and up to down. For example, the first card to pay is the jack, then the queen, then the king, then the eight, then the nine, then the ten, etc. In another embodiment, the first card to be paid may be the king, then queen, jack, ten, nine, eight, etc. The dealer has to pay the single winning cards with one dolly by picking up the dolly with his left hand, straightening up the chips with the right hand from up to down, smallest to largest values, and placing the dolly on the same number, i.e., card value box, as the winning card/bet. In a preferred embodiment, if more than one winning card exists in one column, the dollies may be placed diagonally. For example, if one of the seven, the six, and the five came out, each dolly should be placed in the following position: ⁝.

Then the dealer has to pay the doubled cards by picking up both dollies using both hands to lift the dollies and to place them under the same number line, and straightening the winning chips. If more than one doubled card exists in the same column, the dollies are preferably placed horizontally in the card value box. For example, if a pair of fours, threes and two are drawn, that is three pairs in the same column, then the dollies are preferably placed as follows: ⁝ ⁝.

Then the dealer pays the three of a kind cards by lifting the dollies using both hands for the first two and then the left hand for the third, straightening up the chips with the right hand, and placing the dollies horizontally under the same column of winning bets. If two winning tripled cards exist in the same column, the dollies are preferably placed horizontally. For example, if three jacks and three queens are drawn, the dollies are preferably positioned in those card value boxes as follows: : : :. The dealer then pays the four-of-a-kind cards. The dollies should be picked up with both hands and placed under the column of the winning cards as follows: . . . ..

After paying the even chances, the dealer pays the winning high stakes chances and the winning bets which were moved to the high return area 44. The process preferably starts by lining the winning chips from up to down and smaller to larger amounts. The paying process may occur with the same sequence as described above. The payout is preferably prepared in the paying area (dealer's area), and the winning chips are preferably sent with the payout to the player.

Finally in the case of hitting/winning very high stakes chances or optional bets, the dealer preferably declares which optional bets are winners, how much it pays and the amount of the winning bets. The payout preferably starts with the straight and finishes with four-of-a-kind. The dealer lifts the dolly with the left hand, straightens up the chips, places the dolly back on the box, and in the case of a mixed line, keeps the dolly between the lines. After preparing the payout in the dealer's area, the dealer sends the payment to the player keeping the winning chips in their boxes. The sequence of the payout is preferably always from up to down and smallest to largest amounts.

The dealer pays every winning bet separately, by preferably placing the payout next to the winning chips. The dealer must be firm about the players not taking the chips before the whole payout is over. After paying the whole card value area and layout, the dealer brings the dolly (dollies) back to the dolly area.

After the payout is complete, the dealer declares "place your bets" and stacks the six cards, placing them in front of him in the dealer's area, and not in the card box area. The dealer takes out the rest of the cards and places them over the six cards preparing for another shuffle/hand.

Important keys to remember in playing the casino game 40 of the present invention include, but are not limited to, the following:

for the security and speed of the game, a card shuffling machine is preferred;

after lining up the cards in an ascending manner, if there are any winning optionals, the dealer declares the winning optional, and clears the losing chips by picking them up, wherein this process is preferably done with the clearing of the layout;

if the minimum bet on a suited card is one unit, then the minimum bet on the number card is preferably five units because of the privilege of the player doubling his winning chances when the number card out is doubled;

the chip that touches the line between the card value box and the suit box area is preferably considered a suited card bet, and in the case of a mixed suit line, it is a no bet;

brushing is a must while clearing the layout because of the possibility of covering any winning numbers the manual card shuffle must be well controlled because of the big risk of exposing any of the winning cards;

the cards high stand is made for the security of not mixing the losing chips with the cards while clearing the layout; accordingly, the cards high stand is higher than the original layout.

Figure 2:
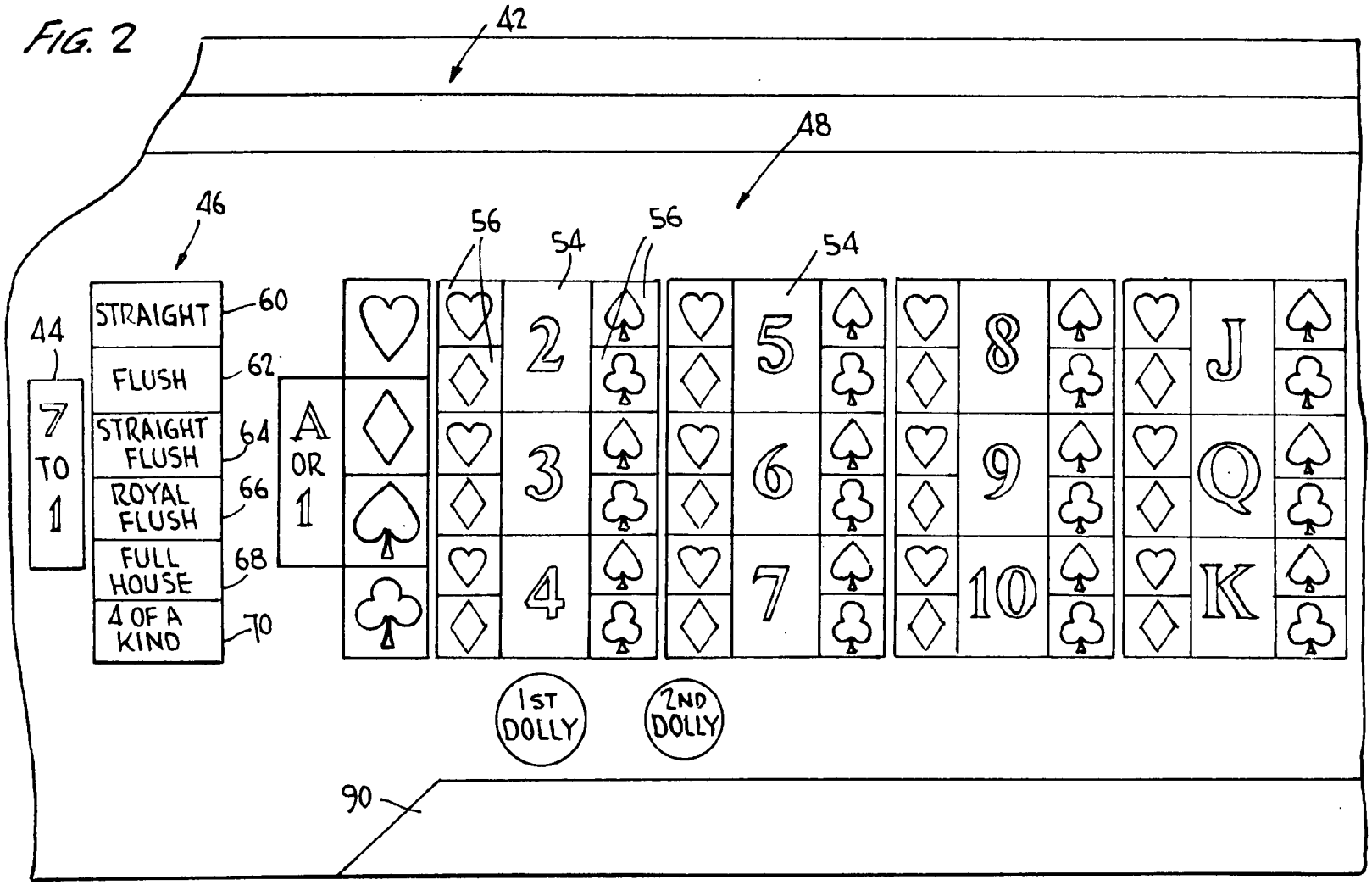
FIG. 2 is a top view of the layout of the casino game of FIG. 1.
Figure 4:
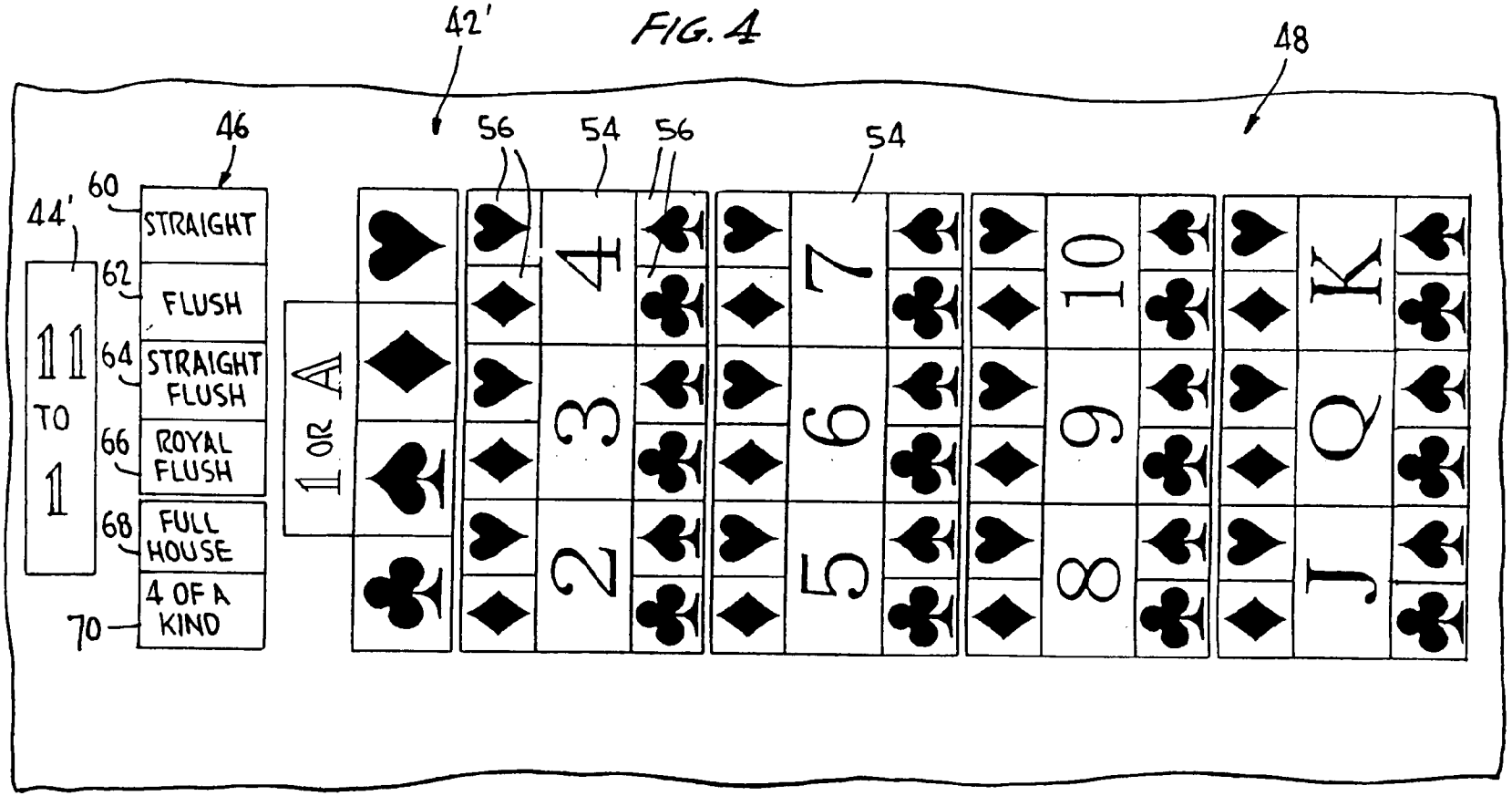
FIG. 4 is another embodiment of the layout of the casino game of the present invention.
Figure 5:
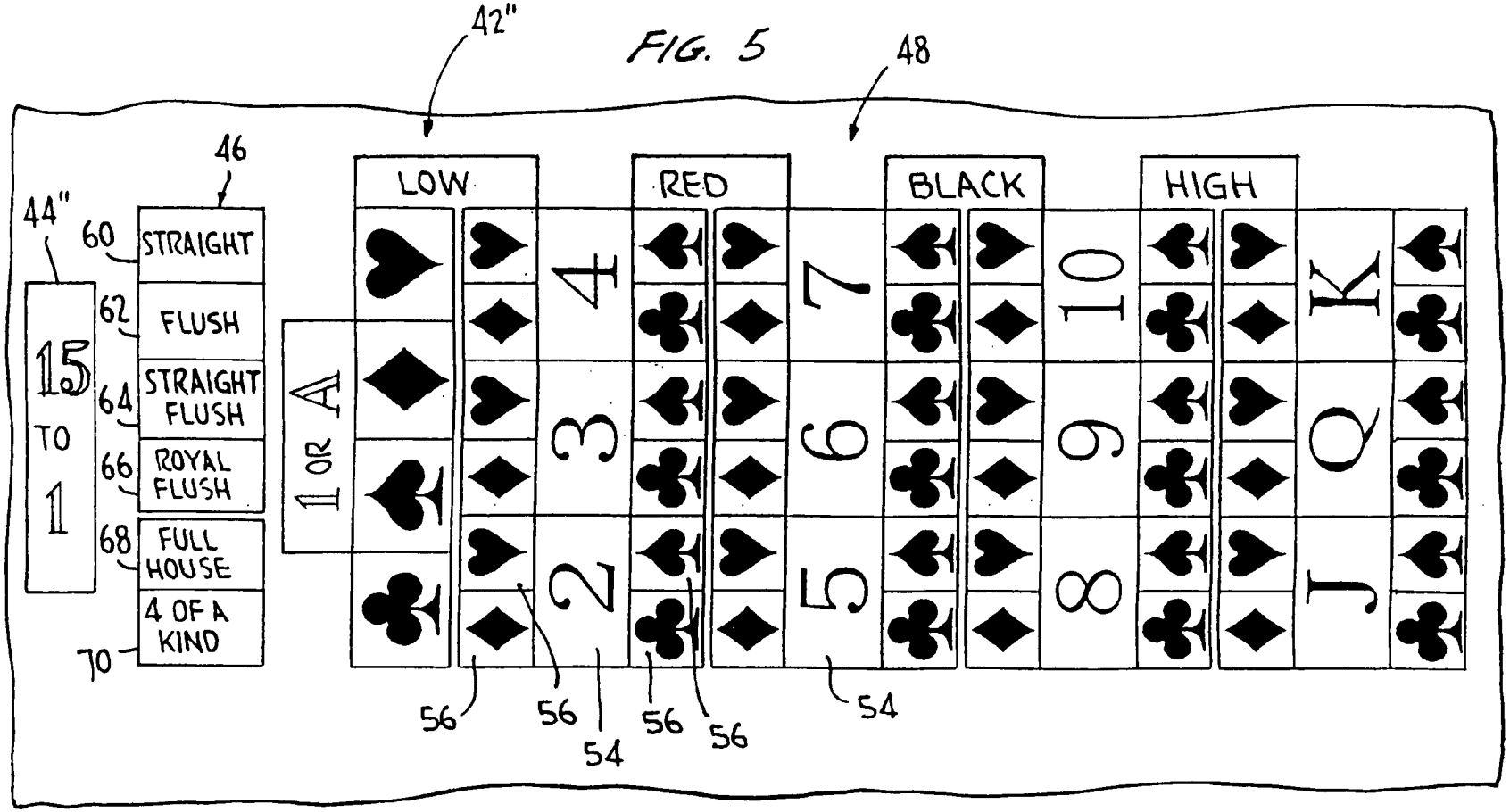
FIG. 5 is another embodiment of the casino game of the present invention.

Preferred layouts 42,42',42" of the casino game 40 of the present invention are shown in FIGS. 2, 4 and 5. The arrangement of all of the boxes, including the card value boxes 54 and the suit boxes 56, are preferably lined inside the casino game as follows.

A first column is preferably a high return area 44. The high return area 44 preferably has a value equal to the rate of return for the high stakes chances of the casino game. A second column is preferably an optional bets column 46 comprising a first box for a straight 60, a second box for a flush 62, a third box for a straight flush 64, a fourth box for a royal flush 66, a fifth box for a full house 68, and a sixth box for a four-of-a-kind 70. A third column is preferably an ace (or one) column. A fourth column is preferably suit boxes of the ace column comprising a first box for the heart, a second box for the diamond, a third box for the spade, and a fourth box for the club.

A fifth column is preferably the red suit boxes, i.e., the hearts and diamonds, of the two, three, and four card values, preferably comprising a first box for the heart of the card value two (2), a second box for the diamond of the card value two (2), a third box for the heart of the card value three (3), a fourth box for the diamond of the card value three (3), a fifth box for the heart of the card value four (4), and a sixth box for the diamond of the card value four (4). A sixth column preferably comprises the card value boxes of the two (2), three (3), and four (4). In a preferred embodiment, the sixth column preferably comprises a first box for the card value two (2), a second box for the card value three (3), and a third box for the card value four (4). A seventh column is preferably the black suit boxes, i.e., the spades and clubs, of the two (2), three (3), and four (4) card values, preferably comprising a first box for the spade of the card value two (2), a second box for the club of the card value two (2), a third box for the spade of the card value three (3), a fourth box for the club of the card value three (3), a fifth box for the spade of the card value four (4), and a sixth box for the club of the card value four (4).

An eighth column is preferably the red suit boxes of the five (5), six (6), and seven (7) card values, preferably comprising a first box for the heart of the card value five (5), a second box for the diamond of the card value five (5), a third box for the heart of the card value six (6), a fourth box for the diamond of the card value six (6), a fifth box for the heart of the card value seven (7), and a sixth box for the diamond of the card value seven (7). A ninth column preferably comprises the card value boxes of the five (5), six (6), and seven (7). In a preferred embodiment, the ninth column preferably comprises a first box for the card value five (5), a second box for the card value six (6), and a third box for the card value seven (7). The tenth column is preferably the black suit boxes of the five (5), six (6), and seven (7) card values, preferably comprising a first box for the spade of the card value five (5), a second box for the club of the card value five (5), a third box for the spade of the card value six (6), a fourth box for the club of the card value six (6), a fifth box for the spade of the card value seven (7), and a sixth box for the club of the card value seven (7).

An eleventh column is preferably the red suit boxes of the eight (8), nine (9), and ten (10) card values, preferably comprising a first box for the heart of the card value eight (8), a second box for the diamond of the card value eight (8), a third box for the heart of the card value nine (9), a fourth box for the diamond of the card value nine (9), a fifth box for the heart of the card value ten (10), and a sixth box for the diamond of the card value ten (10). A twelfth column preferably comprises the card value boxes of the eight (8), nine (9), and ten (10). In a preferred embodiment, the twelfth column preferably comprises a first box for the card value eight (8), a second box for the card value nine (9), and a third box for the card value ten (10). A thirteenth column is preferably the black suit boxes of the eight (8), nine (9), and ten (10) card values, preferably comprising a first box for the spade of the card value eight (8), a second box for the club of the card value eight (8), a third box for the spade of the card value nine (9), a fourth box for the club of the card value nine (9), a fifth box for the spade of the card value ten (10), and a sixth box for the club of the card value ten (10).

A fourteenth column is preferably the red suit boxes of the jack (J), queen (Q), and king (K) card values, preferably comprising a first box for the heart of the card value jack (J), a second box for the diamond of the card value jack (J), a third box for the heart of the card value queen (Q), a fourth box for the diamond of the card value queen (Q), a fifth box for the heart of the card value king (K), and a sixth box for the diamond of the card value king (K). A fifteenth column preferably comprises the card value boxes of the jack (J), queen (Q), and king (K). In a preferred embodiment, the fifteenth column preferably comprises a first box for the card value jack (J), a second box for the card value queen (Q), and a third box for the card value king (K). A sixteenth column is preferably the black suit boxes of the jack (J), queen (Q), and king (K) card values, preferably comprising a first box for the spade of the card value jack (J), a second box for the club of the card value jack (J), a third box for the spade of the card value queen (Q), a fourth box for the club of the card value queen (Q), a fifth box for the spade of the card value king (K), and a sixth box for the club of the card value king (K).

While the preferred layout of the casino game has been described above, the casino game may comprise any suitable layout that is in accordance with the scope of the present invention.

Figure 3:
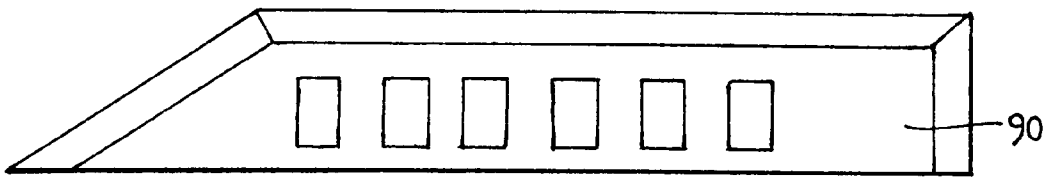
FIG. 3 is a perspective view of the card stand of FIG. 1.

The card stand 90 of the casino game is shown in FIGS. 1–3. The dealer preferably places the drawn cards on the card stand 90 so that the drawn cards may be easily viewed by the dealer and the players and not interfere with the chips on the game layout 42.

Unique aspects of the casino game also include, but are not limited to, (1) the layout of the value card boxes 54, suit boxes 56, optional bets boxes 46 and high return area 44; (2) the layout of the card stand 90; (3) the fact of preferably drawing six cards from a deck of fifty-two cards; (4) the rates of return (payouts) for the even chances, the high stake even chances (doubled or tripled or quadrupled cards out), the high return area and the very high stake rate of return (optional bets); and (5) the way the game is dealt, and the bets offered, as they have been described above.

The casino game of the present invention, may be played in accordance with two other embodiments of the casino game of the present invention. These embodiments use the same layout as described above, except that the high return area 44 may be a high return area 44' having a value of 11-to-1, as shown in FIG. 4, or a high return area 44" having a value of 15-to-1, as shown in FIG. 5. The value of these high return areas preferably correspond to the rate of return of the high stakes chances in those embodiments. These values/rates of return are preferably determined based on the number of cards drawn in the embodiments, which is described hereafter.

These embodiments use the same procedures, the same bets offered, the same percentages, the same tools, the same terms of dealing, but their payouts and their card draws are different. These embodiments are described hereafter.

In an embodiment of the casino game of the present invention having the layout preferably shown in FIG. 4, the dealer preferably draws four cards. Accordingly, the rates of return/payouts for the embodiment of the game where four cards are drawn are preferably as follows:

even chances pays 2-to-1 for one winning card from among the four drawn; 5-to-1 for two winning cards of the same kind among the four cards drawn; 8-to-1 for three winning cards of the same kind among the four cards drawn; and 11-to-1 for four winning cards of the same kind among the four cards drawn.

For the high stakes chances, the winning suited card pays 11-to-1. The 11-to-1 rate of return for the high stakes chances and the value of the high return area 44' is determined based upon the odds/probabilities of only four cards being drawn. The very high stakes chances or optional bets pay the same as detailed above in the embodiment where six cards are drawn, but the dealer draws two extra cards after finishing the whole payout in order to determine the optional bets.

In this embodiment, only five dollies are needed, i.e., one small dolly and four big dollies.

In this embodiment, the even chances payouts that must be paid in the dealer's area are the 5-to-1, the 8-to-1 and the 11-to-1. For the optional bets, the dealer has to leave those bets uncleared until he makes all of the other payouts. The dealer should then draw two extra cards to know if there are winning optionals. If there are winning optionals, the dealer should pick up the small dolly and place it on the cards high stand before clearing the layout and should place it in the winning optional box. The dealer clears the losing optional bets by picking them up, placing them in the chipping area, and then making the payout. If there is no winning optionals bets, the dealer brings down the losing chips with his left hand and scoops them with the right towards the chipping area.

In an embodiment of the casino game of the present invention having the layout preferably shown in FIG. 5, the dealer preferably draws only three cards. Due to this fact, the payouts are preferably as follows: even chances pays 3-to-1 for one winning card from among the three drawn; 7-to-1 for two winning cards of the same kind from among the three drawn; and 11-to-1 for three winning cards of the same kind from among the three drawn. For the high stakes chances, the winning suited card pays 15-to-1. The 15-to-1 rate of return for the high stakes chances and the value of the high return area 44" is determined based upon the odds/probabilities of only three cards being drawn. The very high stakes chances or optional bets pay the same as in the embodiment of the game where six cards are drawn. However, for the optional bets, the dealer has to draw three extra cards following the same procedures as detailed above in order to determine the optional bets.

In this embodiment of the game of the present invention, only four dollies are needed, i.e., one small dolly and three big dollies.

In this embodiment where three cards are initially drawn, four extra optional bets may be used. These bets preferably include high, low, red and black. A corresponding box is located on the layout of the casino game of the present invention, as shown in FIG. 5. For these bets, a player may bet on whether a high card will be drawn, a low card will be drawn, a red card will be drawn, and/or a black card will be drawn.

For the embodiments of the game of the present invention played with three or four cards initially drawn, the optional bets may also be played on a combination of five cards from five drawn. However, the payouts are preferably changed based on the probabilities.

While the preferred rates of return/payouts of the embodiments of the casino game of the present invention having three or four cards initially drawn have been detailed above, any suitable rates of return/payouts may be used in these embodiments of the casino game of the present invention.

The casino game of the present invention may also be in the form of a slot machine game set-up or a home-use game set-up, such as, but not limited to, being small enough so that it is easily portable.

The exemplary embodiments herein disclosed are not intended to be exhaustive or to unnecessarily limit the scope of the invention. The exemplary embodiments were chosen and described in order to explain the principles of the present invention so that others skilled in the art may practice the invention. As will be apparent to one skilled in the art, various modifications can be made within the scope of the aforesaid description. Such modifications being within the ability of one skilled in the art form a part of the present invention and are embraced by the appended claims.

It is claimed:

1. A casino game comprising:

a standard deck of cards;

a game layout, wherein said game layout comprises:

a card value area having a card value box for each of thirteen valued cards in said deck and a box for each of four card suits adjacent to said card value box for each of said thirteen valued cards, a high return area for making payouts by a dealer, an optional bets area, a card stand, and optionally a color chip area and/or a cash area for keeping color chips or cash not being bet by a player;

at least one first dolly; and at least one second dolly;

wherein at least one player places a bet on said game layout, wherein said dealer draws a plurality of cards from said deck of cards, wherein said dealer marks each card value drawn from said plurality of cards drawn with said at least one first dolly and said dealer marks each suit of each of said plurality of cards drawn with said at least one second dolly, wherein where said at least one player's bet corresponds to at least one of said plurality of cards drawn, then said at least one player receives a payout.

2. The casino game of claim 1, wherein said thirteen valued cards comprise an ace or one, two, three, four, five, six, seven, eight, nine, ten, jack, queen and king.

3. The casino game of claim 1, wherein said four card suits comprise a heart, diamond, spade and club.

4. The casino game of claim 1, wherein said bet includes at least one of even chances, high stakes chances and very high stakes chances, wherein said even chances comprise betting on a single valued card without indicating its suit, wherein said high stakes chances comprise betting on a single valued card and its suit, and wherein said very high stakes chances comprise betting on optional bets which are based on a combination of drawn cards.

5. The casino game of claim 4, wherein said optional bets comprise at least one of a straight, flush, straight flush, royal flush, full house and/or four-of-a-kind.

6. The casino game of claim 4, wherein said payout for said even chances is even money when a player wins on one valued card, 3-to-1 when a player's card is doubled among said drawn cards, 5-to-1 when a player's card is tripled among said drawn cards, and 7-to-1 when a player's card comes out four times among said drawn cards.

7. The casino game of claim 4, wherein said payout for said high stakes chances is 7-to-1 when a player's card value and suit is among said drawn cards.

8. The casino game of claim 4, wherein said payout for said very high stakes chances is 5-to-1 for a straight, 10-to-1 for a flush, 1000-to-1 for a straight flush, 2000-to-1 for a royal flush, 20-to-1 for a full house and 200-to-1 for a four-of-a-kind.

9. The casino game of claim 4, wherein said payout for said very high stakes chances is 25-to-1 for a straight, 50-to-1 for a flush, 1000-to-1 for a straight flush, 2000-to-1 for a royal flush, 100-to-1 for a full house and 500-to-1 for a four-of-a-kind.

10. The casino game of claim 1, wherein said optional bets area comprises a box for each of a straight, a flush, a straight flush, a royal flush, a full house and a four-of-a-kind.

11. The casino game of claim 1, further comprising a card stand, wherein said dealer places said plurality of cards drawn on said card stand so said plurality of cards can be easily viewed by said dealer and said at least one player.

12. A method of playing a casino game comprising:

(a) placing at least one bet by at least one player on a game layout, said game layout comprising a card value area having a card value box for each of thirteen valued cards in said deck and a box for each of four card suits adjacent to said card value box for each of said thirteen valued cards;

(b) drawing a plurality of cards, one card at a time, by a dealer from a deck of cards, wherein said dealer announces a card value and a suit for each of said plurality of cards drawn;

(c) placing a first dolly on said game layout to mark said card value for each of said plurality of cards drawn;

(d) placing a second dolly on said game layout to mark said suit for each of said plurality of cards drawn; and (e) distributing a payout for each of said at least one bet which is a winning bet based upon said plurality of cards drawn, said at least one bet is a winning bet when said at least one bet corresponds to at least one of said plurality of cards drawn by said dealer.

13. The method of playing a casino game of claim 12, further comprising clearing said at least one bet which is a losing bet based upon said plurality of cards drawn and said plurality of cards drawn from said game layout.

14. The method of playing a casino game of claim 13, further comprising repeating (a) through (e) a predetermined plurality of times.

15. The method of playing a casino game of claim 12, further comprising repeating (a) through (e) a predetermined plurality of times.

16. The method of playing a casino game of claim 12, wherein said casino game comprises:

a standard deck of cards;

said game layout further comprises:

a card value area, a high return area for making payouts by a dealer, an optional bets area, a card stand, optionally a color chip area, and/or a cash area for keeping color chips or cash not being bet by a player;

at least one first dolly; and at least one second dolly.

17. The method of playing a casino game of claim 16, wherein said card value area comprises a card value box for each of thirteen valued cards in said deck and a box for each of four card suits adjacent to said card value box for each of said thirteen valued cards.

18. The method of playing a casino game of claim 17, wherein said thirteen valued cards comprise an ace or one, two, three, four, five, six, seven, eight, nine, ten, jack, queen and king.

19. The method of playing a casino game of claim 17, wherein said four card suits comprise a heart, diamond, spade and club.

20. The method of playing a casino game of claim 16, wherein said optional bets area comprises a box for each of a straight, a flush, a straight flush, a royal flush, a full house and a four-of-a-kind.

21. The method of playing a casino game of claim 16, further comprising a card stand, wherein said dealer places said plurality of cards drawn on said card stand so that said plurality of cards can be easily viewed by said dealer and said at least one player.

22. The method of playing a casino game of claim 12, wherein said at least one bet includes at least one of even chances, high stakes chances and very high stakes chances, wherein said even chances comprise betting on a single valued card without indicating its suit, wherein said high stakes chances comprise betting on a single valued card and its suit, wherein said very high stakes chances comprise betting on optional bets which are based on a combination of drawn cards.

23. The method of playing a casino game of claim 22, wherein said payout for said even chances is even money when a player wins on one valued card, 3-to-1 when a player's card is doubled among said drawn cards, 5-to-1 when a player's card is tripled among said drawn cards, and 7-to-1 when a player's card comes out four times among said drawn cards.

24. The method of playing a casino game of claim 22, wherein said payout for said high stakes chances is 7-to -1 when a player's card value and suit is among the drawn cards.

25. The method of playing a casino game of claim 22, wherein said payout for said very high stakes chances is 5-to-1 for a straight, 10-to-1 for a flush, 1000-to-1 for a straight flush, 2000-to-1 for a royal flush, 20-to-1 for a full house and 200-to-1 for a four-of-a-kind.

26. The method of playing a casino game of claim 22, wherein said payout for said very high stakes chances is 25-to-1 for a straight, 50-to-1 for a flush, 1000-to-1 for a straight flush, 2000-to-1 for a royal flush, 100-to-1 for a full house and 500-to-1 for a four-of-a-kind.

* * * * *